US005450651A

United States Patent [19]

Coleman et al.

[11] Patent Number: 5,450,651

[45] Date of Patent: * Sep. 19, 1995

[54] END CAP LOCKING OVERHEAD MOUNTED DOOR HOLDER ASSEMBLY

[75] Inventors: Michael D. Coleman, Indianapolis; Paul J. Haeck, Carmel; Herman M. Tilly, Indianapolis, all of Ind.

[73] Assignee: Von Duprin, INC., Indianapolis, Ind.

[ * ] Notice: The portion of the term of this patent subsequent to Sep. 5, 2012 has been disclaimed.

[21] Appl. No.: 138,168

[22] Filed: Oct. 15, 1993

[51] Int. Cl.[6] ..... F05C 17/00; E05F 5/00

[52] U.S. Cl. ..... 16/82; 16/49; 292/274; 49/346

[58] Field of Search ..... 16/65, 82, 370, 49; 292/271, 274, 275, 278; 49/339, 340, 346

[56] References Cited

U.S. PATENT DOCUMENTS

| | | | |
|---|---|---|---|
| 1,986,677 | 1/1935 | Johnson | 292/278 |
| 2,168,453 | 8/1939 | Sibley | 292/273 |
| 2,497,830 | 2/1950 | Bernhard | 292/275 |
| 3,108,891 | 2/1938 | Johnson | 16/82 |
| 3,601,842 | 8/1971 | Morrison et al. | 292/274 |
| 3,630,560 | 12/1971 | Atkins et al. | 292/278 |
| 3,683,450 | 8/1972 | Morrison et al. | 16/82 |
| 4,864,686 | 9/1989 | Lasier et al. | 16/49 |

*Primary Examiner*—Lowell A. Larson
*Assistant Examiner*—Donald M. Gurley
*Attorney, Agent, or Firm*—Robert F. Palermo; A. James Richardson

[57] ABSTRACT

An overhead mounted door holder assembly for attachment between a door jamb and a door, to hold the door in an open position, includes a jamb bracket attached to the door jamb and a jamb arm pivotally attached to the jamb bracket. A channel assembly having a longitudinally extending channel is attached to the door, and first and second end caps are attachable to opposing ends of the channel assembly, with each end cap being held by a retaining key in locked connection with the channel assembly. The first and second end caps are configured to allow alternate positioning of the channel assembly inset in a top of the door or attached to a side of the door. A hold open stop is fixably held in the channel of the channel assembly. The hold open stop is configured to have a stop element for engaging a slide assembly pivotally attached to the jamb arm and positioned for longitudinal movement in the channel. The slide assembly is configured to engage the stop element of the hold open stop and hold the door in an open position. The force required to engage the hold open stop and the slide assembly is determined by the position of an adjustment wedge.

14 Claims, 5 Drawing Sheets

END CAP LOCKING OVERHEAD MOUNTED DOOR HOLDER ASSEMBLY

BACKGROUND OF THE INVENTION

This invention relates generally to overhead door holders and, more particularly, to an adjustable overhead mounted door holder assembly configured for optional mounting either in a door top inset or on the door face parallel to a top edge of the door.

Temporarily holding a door in an open position is sometimes required for convenience and safety. One common method uses an overhead mounted door control device that includes a pivoting arm attached between an upper portion of the door jamb and an upper part of the door. When the door is to be held open at an angle less than about 110 degrees, an overhead mounted door control device is efficient, effective, convenient to install and maintain, less subject to damage by vandalism or accidents, and does not present a potential stumbling hazard.

Commonly, a door holder is inset into the top of the door, or alternatively attached to the face of the door. It should be set to permit easy engagement, to hold the door against minor amounts of jostling contact without release, and yet to still permit closing the door without undue effort. It is also very desirable that the door holder is designed to be adjusted or replaced with minimal effort and expertise. Large easily manipulated locking elements that hold together the assembly are preferable to small diameter pins or other fastening means that require special tools or coordination.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an adjustable overhead mounted door holder assembly, for attachment between a door jamb and a door, for selectively holding the door in an open position including a jamb bracket attached to the door jamb and a jamb arm pivotally attached to the jamb bracket; a channel assembly having a longitudinally extending, substantially straight channel; first and second end caps attachable to opposing ends of the channel assembly, each being held in place by a retaining key that locks into the channel assembly, the first and second end caps being configured to allow attachment of the channel assembly as an inset in the top of the door or on the face of the door parallel to the top of the door.

The foregoing and other aspects will become apparent from the following detailed description of the invention when considered in conjunction with the accompanying drawing figures.

DETAILED DESCRIPTION OF THE INVENTION

Figure 1:
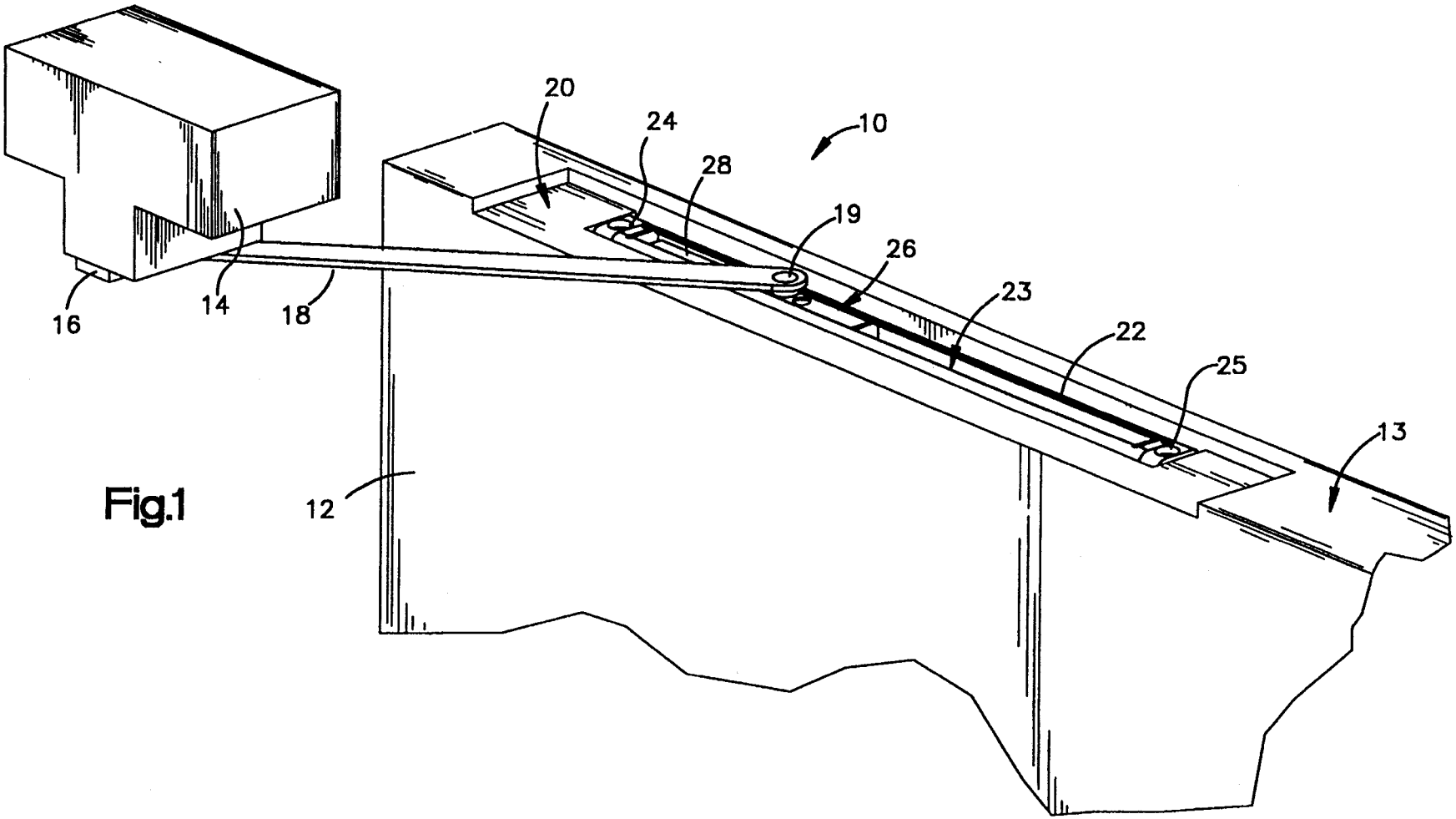
FIG. 1 is a perspective view of an overhead mounted door holder assembly with its channel assembly inset into the top of a door.

As illustrated in FIG. 1, a door holder assembly 10 has a channel assembly 22 positioned in a door inset 20 at an upper edge 13 of a door 12. The channel assembly 22 is attached by fasteners (not shown) passing through openings 64 and 65 in first and second end caps 24 and 25 to the door 12 so that its longitudinally extending and generally U-shaped channel 23 is upwardly open. Positioned for sliding movement within the channel 23 and between the end caps 24 and 25 is a slide assembly 26. The assembly 10 also includes a jamb bracket 16 permanently affixed to a door jamb 14. A jamb arm 18 is pivotally connected at one end to the jamb bracket 16 and at its opposite end to the slide assembly 26 by pivot pin 19. In preferred embodiments, the jamb bracket 16, jamb arm 18 and channel assembly 22 are formed from brass or other durable, wear resistant material such as steel.

Figure 2:
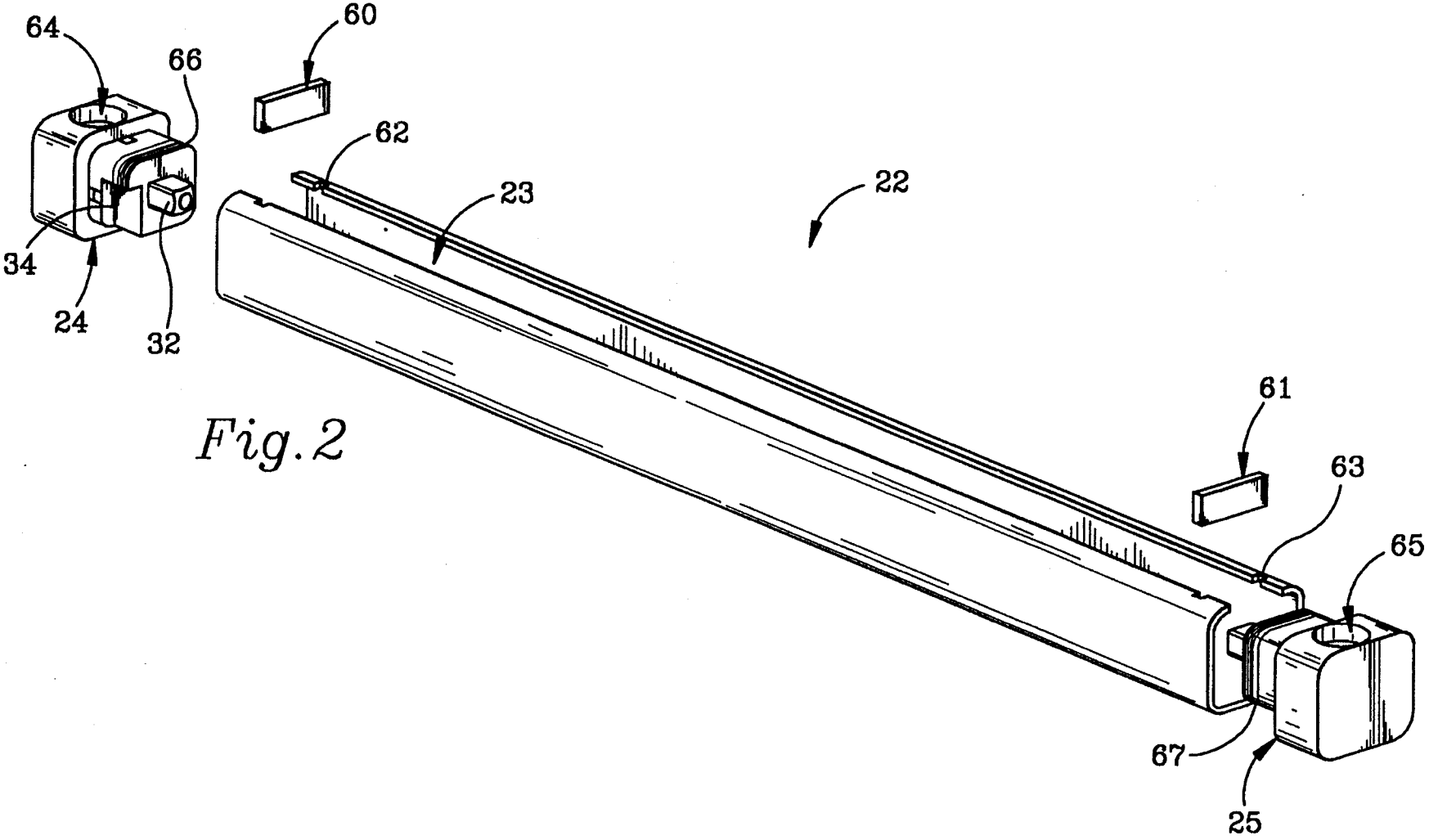
FIG. 2 is an exploded perspective view of the channel assembly illustrating the end caps and the retaining keys used to hold the caps in position at opposite ends of the channel.

As best shown in FIG. 2, the channel assembly 22 is supported by end caps 24 and 25 that are attached by retaining keys 60 and 61, which fit into slots 66 and 67 respectively. The retaining keys 60 and 61 fit through notches 62 and 63 in the channel assembly 22 to fix and hold the end caps 24 and 25 in position. This arrangement advantageously allows easy removal of the end caps 24 and 25 simply by prying the retaining keys 60 and 61 out from the notches 62 and 63, and pulling the now unlocked end cap out from the channel 23 of the channel assembly 22. After the channel assembly 22 is disconnected from its end caps, repair, change of function, replacement, or maintenance of the door holder assembly 10 is efficient and simple, generally requiring no special tools.

Figure 3:
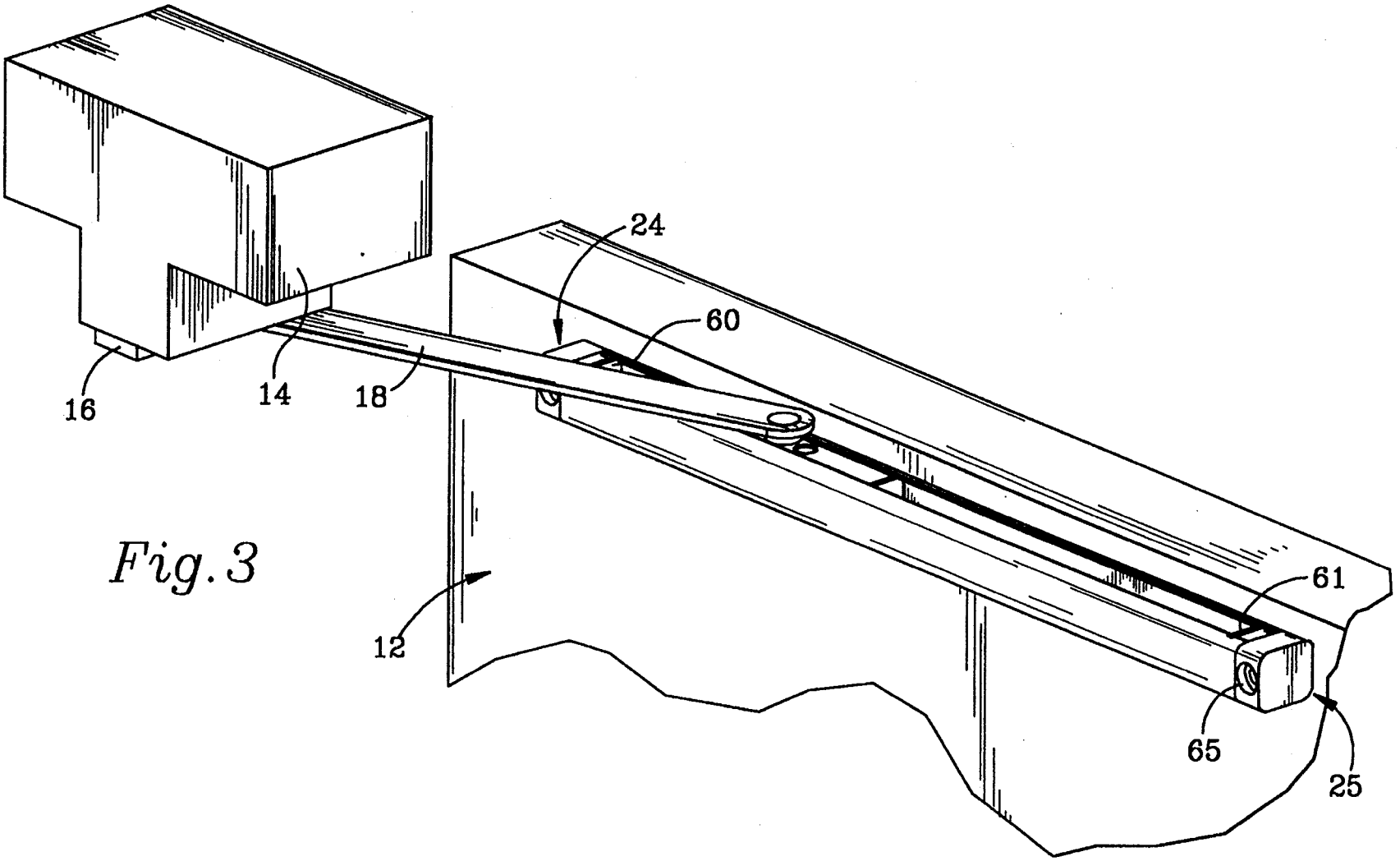
FIG. 3 is a perspective view of the door holder assembly attached to a face of the door, with an upward orientation of the channel.

An alternative mounting of the door holder assembly 10 is illustrated by FIG. 3, which shows the channel assembly 22 of the assembly 10 mounted on a face of the door 12 using end caps 24 and 25 rotated by 90°. Like that embodiment shown in FIG. 1, the U-shaped channel 23 having inserted slide assembly 26 is mounted so that it is upwardly open. Operation of the door holder assembly 10 is identical in the embodiments illustrated in FIG. 1 and FIG. 2, with the different positioning being determined by the characteristics of the top of the door.

With reference to FIGS. 1 and 3, when the door 12 is closed with its upper edge 13 adjacent to the door jamb 14, the slide assembly 26 is positioned in the channel 23 near the end cap 25. As the door 12 is opened, the pivoting connection of the jamb arm 18 between the jamb bracket 16 and the slide assembly 26 allows the slide assembly to move along the channel 23 toward the first end cap 24. As the slide assembly 26 moves toward the first end cap 24, it engages a hold open stop 28 that temporarily holds the door in an open position. This held open position is illustrated in FIGS. 1 and 3, which show the door 12 in almost wide open state rotated about 100 degrees relative to the door jamb 14.

Figure 4:
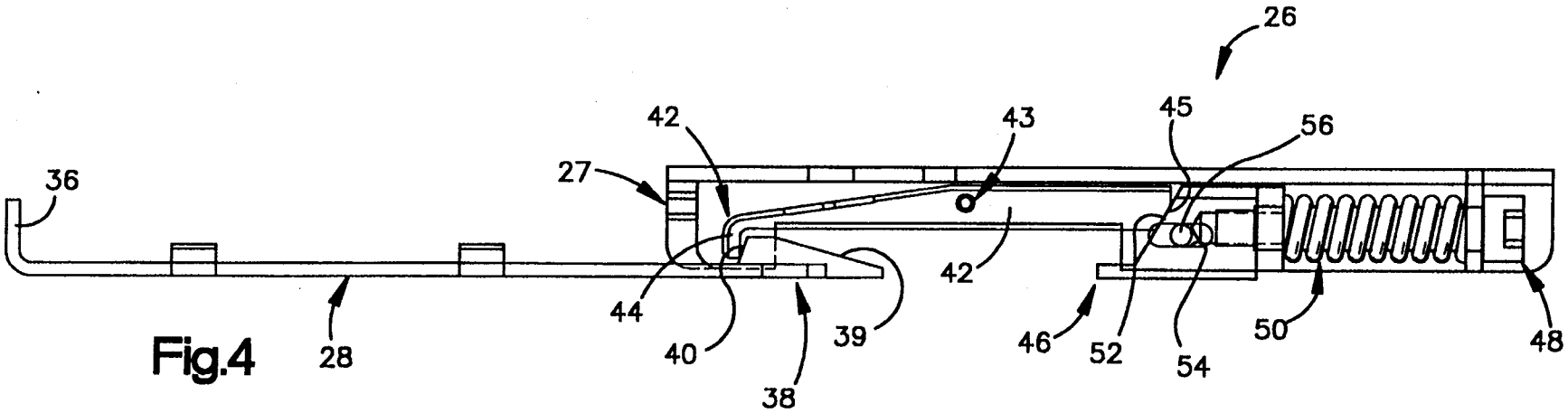
FIG. 4 is a side view of a slide assembly and a hold open stop of the present invention.

The individual components of the hold open stop 28 and the slide assembly 26 are illustrated in FIG. 4. The hold open stop 28 is configured for permanent insertion into the channel assembly 22 and has an integrally formed flange 36 that can be snapped into a notch 34 formed in the first end cap 24 (best seen in FIGS. 2 and 5–8) for locking engagement. At its end opposite from the flange 36, the hold open stop 28 has a stop element 38 which has angled and opposed first and second ramps 39 and 40. The first ramp 39 is typically configured to present a wedge shape surface having a dihedral angle of between about 10 degrees to about 40 degrees, with an angle of 25 to 35 degrees being typical. The dihedral angle presented by the second ramp 40 is much steeper, having a range of between about 50 degrees to about 85 degrees, with angles of 65 degrees to 75 degrees being typical. The stop element 38 engages the slide assembly 26 to hold open the door 12. The slide assembly 26 includes a slide frame 27, an axle pin 43 connected to the slide frame 27 to pivotally support a rocker 42, and a contact element in the form of an adjustment wedge 46 to permit altering the force exerted by the rocker 42 on the stop element 38 of the hold open stop 28. The adjustment wedge 46 has an internally defined wedge slot 54 through which passes a position pin 56 connected to the slide frame 27. The position of the adjustment wedge 46 is itself adjusted by an adjustment screw 48 that engages a compression spring 50 situated between a head of the screw 48 and the adjustment wedge 46.

Figure 5:
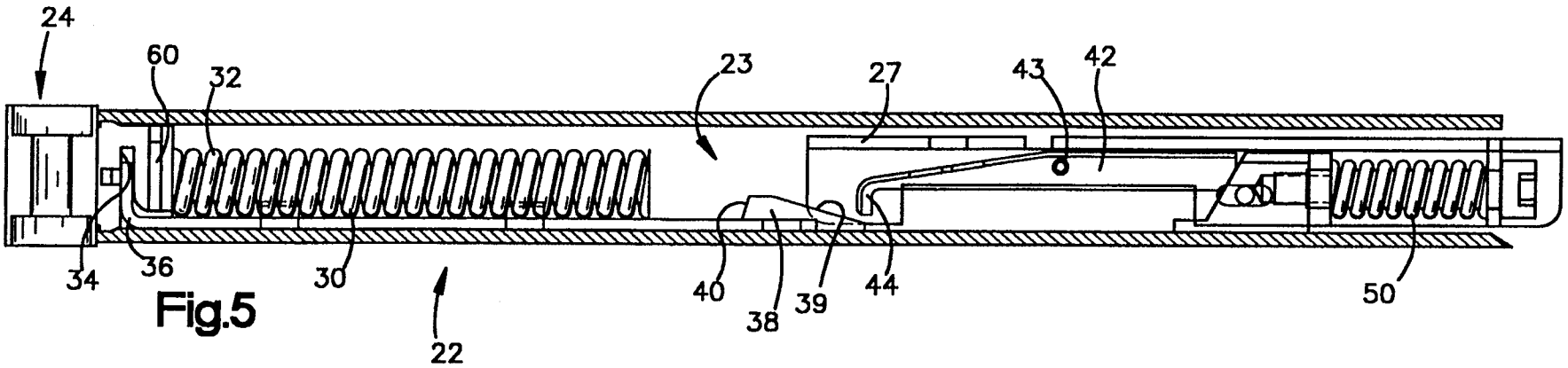
FIG. 5 is a partially sectional side view of the hold open stop positioned in a channel assembly.
Figure 6:
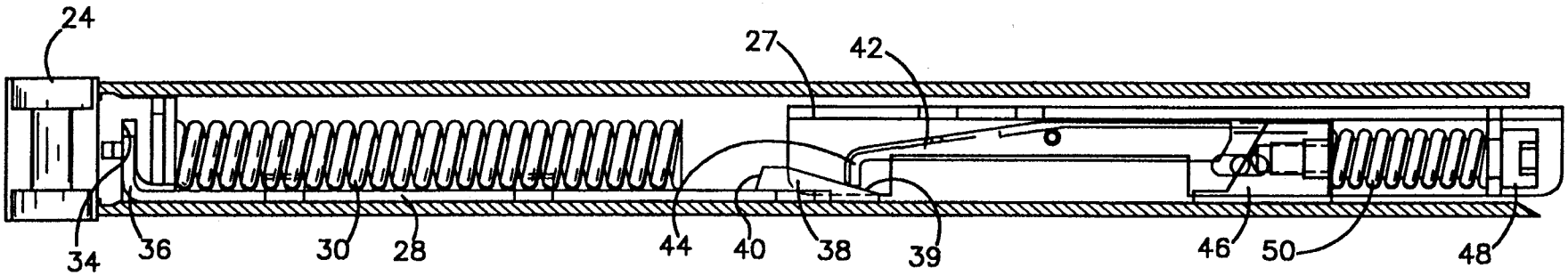
FIGS. 6, 7, and 8 are side views similar to FIG. 5, illustrating three progressive positions of the slide assembly moving toward the hold open stop.
Figure 7:
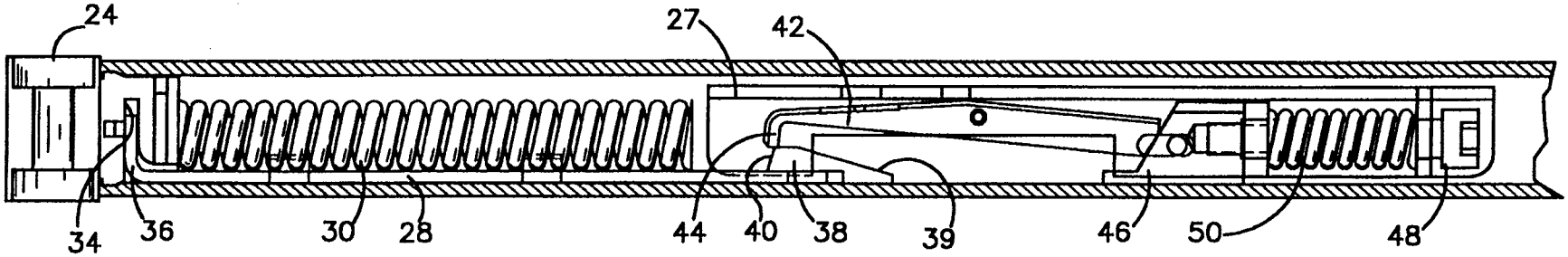
Figure 8:
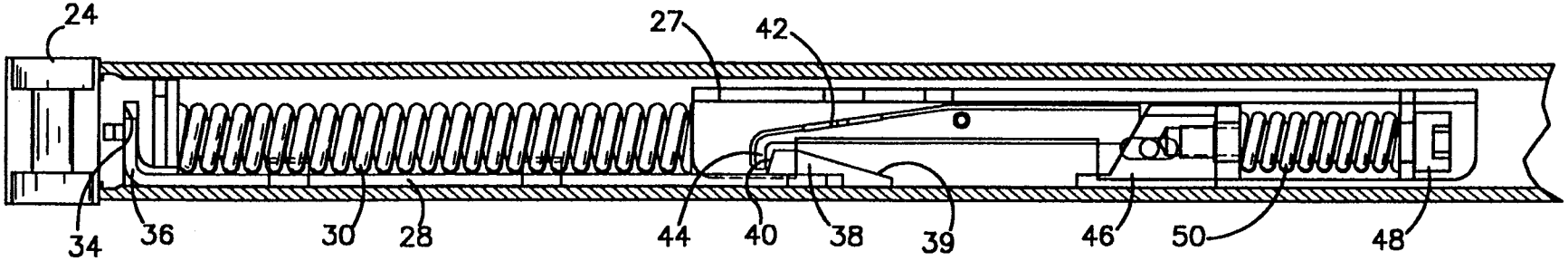

Engagement of the slide assembly 26 and the hold open stop 28 is best illustrated by sequential consideration of FIGS. 5, 6, 7, and 8, which illustrate positions of the slide assembly relative to the hold open stop as the door 12 is opened. More particularly, FIG. 5 shows a catch 44 of the rocker 42 just prior to contact with the stop element 38 of the hold open stop 28; FIG. 6 shows the position of the catch 44 on the first ramp 39 of the stop element 38 as the slide assembly moves closer to the hold open stop 28; FIG. 7 shows the position of the catch 44 just prior to sliding down the second ramp 40 of the stop element 38; and FIG. 8 shows the position of the catch 44 in a rest, locked engagement with the second ramp 40 of the stop element 38 with the door in a hold open position. A reversal of this sequence is required to disengage the door from the hold open position, however, a greater force is required to pull the catch 44 up the steeper angled second ramp 40 as compared to the force required to push the catch 44 up the gentler angled first ramp 39. This difference in required force ensures that the door will remain in a held open position as long as required, while permitting a nearly normal opening force to temporarily lock the door in the hold open position.

Adjustment of the force needed to impel the catch 44 up the first ramp 39, and pull the catch 44 back up the second ramp 40, is modified with the aid of the adjustment wedge 46. When the rocker 42 rotates about the axle pin 43, a rocker face 45 engages a contact face or wedge face 52 of the adjustment wedge 46. The necessary rotation of the rocker 42 to allow movement of the catch 44 up the first ramp 39 is resisted by the adjustment wedge 46, with the adjustment wedge being pushed against the compression spring 50 and increasing the resistance to rotation of the rocker 42. The precise force can be easily adjusted with readily available tools by tightening or loosening the adjustment screw 48 to change the position of the compression spring 50 (and consequently the position of the adjustment wedge 46). As those skilled in the art will appreciate, although a specific embodiment of an adjustment wedge is described and illustrated, alternative means of resisting rotation of the rocker may also be used, including direct contact of the rocker face with compression or leaf springs, or other known methods for adjustably controlling resistance to rotation.

Another feature of the door holder assembly 10 of the present invention protects the assembly 10 against damage caused by violent opening of the door. A stop spring 30 is positioned in the channel 23 adjacent to the first end cap 24. As best seen in FIGS. 2 and 5, the first end cap has a centering post 32 that supports the spring 30. When the door is opened far enough, the slide frame 27 impacts and is slowed by contact with the spring 30 as shown in FIG. 8. By slowly distributing the force of door opening, the spring 30 prevents shock damage to the assembly 10.

What is claimed is:

1. An adjustable overhead door holder assembly for attachment between a door jamb and a door for selectively holding the door in an open position, the assembly comprising a jamb bracket attached to the door jamb, a jamb arm pivotally attached to the jamb bracket, a channel assembly having a channel therein and attached to the door, first and second end caps attached to opposing ends of the channel assembly, a retaining key holding each end cap in locked connection with the channel assembly, a slide assembly positioned in the channel and adapted for movement in the channel, the slide assembly being pivotally attached to the jamb arm, and a hold open stop positioned to engage the slide assembly for temporarily preventing movement of the slide assembly to hold the door in an open position, the hold open stop further comprising a stop element with a first ramp and a second ramp, the slide assembly comprising a slide frame, a rocker having a catch at one end and a wedge shaped rocker face at another end, the rocker being pivotably connected between its ends to the slide frame, the catch being configured to slide over the first ramp for reversible engagement with the second ramp of the stop element to hold the door in an open position, the slide assembly further comprising an adjustment wedge having a wedge face complimentary to the wedge shaped rocker face, the adjustment wedge being positioned to contact and slide on the rocker face under the influence of a spring biasing the wedge face into contact with the wedge shaped rocker face to control the force exerted by the rocker on the stop element of the hold open stop.

2. The adjustable overhead door holder assembly of claim 1, wherein the retaining keys further comprise a substantially flat plate configured to fit into notches defined in the channel assembly.

3. The adjustable overhead door assembly of claim 1, wherein the adjustment wedge further defines a wedge slot therethrough, a position pin passing through the slot and attached to the slide frame for providing a predefined limited range of movement of the adjustment wedge with respect to the slide frame and the rocker.

4. The adjustable overhead door assembly of claim 3, wherein the spring comprises a compression spring biasably connected between the adjustment wedge and the slide frame to resist movement of the adjustment wedge as the catch of the rocker moves along the first ramp.

5. The adjustable overhead door assembly of claim 4, further comprising an adjustment screw configured to hold the compression spring and attached to the slide frame to allow adjustment of bias of the compression spring.

6. The adjustable overhead door assembly of claim 1 wherein the first end cap further comprises a centering post, a stop spring retained on the centering post and being positioned to resist compression and absorb door opening force as the slide frame contacts the stop spring.

7. An adjustable overhead door holder assembly for attachment between a door jamb and a door having an upper door edge, the assembly comprising a jamb arm and means for pivotally attaching the jamb arm to a door jam, a channel assembly and mounting means for mounting the channel assembly to the door, the channel assembly extending parallel to the upper door edge, and the channel assembly having a channel defined therein, a door holding means positioned in the channel, the door holding means having a stop element with a first and a second ramp, and sliding means pivotally attached to the jamb arm and positioned for sliding longitudinal movement within the channel, the sliding means having a slide frame, a rocker and a pivot mount pivotally mounting the rocker to the slide frame, the rocker terminating in a catch on a first side of the pivot mount and terminating in a rocker face on an opposite side of the pivot mount, with the catch configured to slide over the first ramp for reversible engagement with the second ramp of the stop element to hold the door in an open position, the door holding means further comprising an adjustment wedge having a wedge face complimentary to the rocker face, the adjustment wedge being positioned to contact and slide on the rocker face under the influence of a spring biasing the wedge face into contact with the rocker face to control the force exerted by the rocker on the stop element of the hold open stop.

8. The adjustable overhead door assembly of claim 7, wherein the mounting means further comprises first and second end caps attached to opposing ends of the channel assembly, each end cap being held by a retaining key in locked connection with the channel assembly.

9. The door assembly of claim 8, wherein the first and second end caps further comprise a notch for attachment to the hold open stop.

10. The door holder assembly of claim 8, wherein the retaining keys further comprise a substantially flat plate configured to fit into notches defined in the channel assembly.

11. The door holder assembly of claim 8, wherein the first and second end caps can be rotated 90 degrees to alternately hold the channel assembly in a position along the side of the door or in a position inset in the door.

12. An adjustable overhead mounted door holder assembly, for attachment between a door jamb and a door, for selectively holding the door in an open position, including:

a jamb bracket for attachment to the door jamb; a jamb arm pivotally having a first end attached to the jamb bracket and a second end; a channel assembly including a channel member, first and second end caps attached to opposite ends of the channel member, the end caps providing means for securing the channel assembly to the door; a hold open stop positioned within the channel member and coupled to one of the end caps, the stop including first and second ramps; and a slide assembly positioned for linear movement in the channel member, the slide assembly comprising:

a slide frame pivotally attached to the jamb arm second end, a rocker, a pivot defining element pivotally attaching the rocker to the frame, the rocker including: a first end having a catch for engaging the hold open stop first and second ramps and a second end, and an adjustable biasing means for adjustably applying a force to oppose movement of the catch up the ramps including a contact element having a contact surface in sliding contact with the rocker second end, at least one of said contact surface and rocker second end consisting essentially of an inclined plane along which said sliding contact occurs in response to displacement of the rocker first end by said ramps.

13. The door holder assembly of claim 12 wherein the adjustable biasing means further comprises a spring having a first end connected to the contact element and a second end, a screw engaging the slide frame and the spring second end for adjusting the amount of force applied to the contact element by the spring.

14. The door holder assembly of claim 13 wherein the adjustable biasing means further comprises means for limiting the movement of the contact element with respect to the slide frame including a slot in the contact element and a pin passing through the slot and fixed to the frame.

* * * * *